US006686524B2

(12) United States Patent
Hirayama

(10) Patent No.: US 6,686,524 B2
(45) Date of Patent: Feb. 3, 2004

(54) TREMOLO UNIT FOR STRING INSTRUMENT

(75) Inventor: Shinjiro Hirayama, Seto (JP)

(73) Assignee: Hoshino Gakki Mfg. Co., Ltd. (JP)

( * ) Notice: Subject to any disclaimer, the term of this patent is extended or adjusted under 35 U.S.C. 154(b) by 0 days.

(21) Appl. No.: 10/261,883

(22) Filed: Sep. 30, 2002

(65) Prior Publication Data

US 2003/0140764 A1 Jul. 31, 2003

(30) Foreign Application Priority Data

Jan. 30, 2002 (JP) ..... 2002-021360

(51) Int. Cl.[7] ..... G10D 3/00
(52) U.S. Cl. ..... 84/313; 84/291
(58) Field of Search ..... 84/313, 291

(56) References Cited

U.S. PATENT DOCUMENTS

| | | | | | |
|---|---|---|---|---|---|
| 4,555,970 | A | | 12/1985 | Rose | 84/313 |
| 4,638,711 | A | | 1/1987 | Stroh | 84/313 |
| 4,928,564 | A | | 5/1990 | Borisoff et al. | 84/313 |
| 5,747,713 | A | * | 5/1998 | Clement | 84/313 |
| 5,986,192 | A | * | 11/1999 | Wingfield et al. | 84/313 |
| 6,100,459 | A | * | 8/2000 | Yost | 84/313 |

FOREIGN PATENT DOCUMENTS

| | | |
|---|---|---|
| JP | 1-93793 | 4/1989 |
| JP | 2-48120 | 10/1990 |

* cited by examiner

*Primary Examiner*—Shih-Yung Hsieh
(74) *Attorney, Agent, or Firm*—Ostrolenk, Faber, Gerb & Soffen, LLP

(57) ABSTRACT

A tremolo block extends from the back of a base plate into a space formed in a body. The tremolo block pivots with the base plate. The tremolo block has a hook portion at its distal end. The base is located at the back of the body. Engaging sections are formed at a rear portion of the base and open rearward. A moving member is detachably located at the engaging sections. The moving member is moved between an engaging position, at which the moving member engages with the engaging sections, and a standby position, at which the moving member is separated from the engaging sections. A pair of first springs connect the base with the tremolo block to urge the tremolo block forward against the tension of the strings. The urging force of the first springs is adjustable. A pair of second spring connect the base with the moving member. The second springs urge the moving member toward the engaging position. In a normal state, the second springs hold the moving member at the engaging position. When the tremolo block is stopped or pivoted forward, the moving member is held at the engaging position by the urging force of the second springs. When the tremolo block is pivoted rearward, the moving member is moved from the engaging position to the standby position by contact between the moving member and the hook portion.

15 Claims, 11 Drawing Sheets

TREMOLO UNIT FOR STRING INSTRUMENT

BACKGROUND OF THE INVENTION

The present invention relates to a tremolo unit for string instruments.

Tremolo units for string instruments are widely known and often installed in electric guitars. A tremolo unit increases and decreases the tension of the strings of a string instrument to make the sound of the instrument impressive. FIG. 11 illustrates a typical prior art tremolo unit 110 applied to a guitar. The tremolo unit 110 includes a base plate 111, string supports (bridge saddles) 121, a tremolo body (bridge) 120, a tremolo arm 125, and springs 130. The string supports 121 are pivotally attached to a body B of the guitar and support strings S at the top surface of the base plate 111. The tremolo body 120 has a tremolo block 122 extending inward of the body B below the base plate 111. The tremolo arm 125 is attached to the tremolo body 120 to pivot the tremolo body 120. The springs 130 are located between the tremolo block 122 and the body B. In cooperation with the tension of the strings S, the springs 130 keep the tremolo body 120 at an equilibrium position. The base plate 111 has knife edges 112 at one end. Stud bolts 115, each having a groove, are fixed to the body B. Each stud bolt 115 pivotally supports the corresponding knife edge 112 at the groove. Spring engaging member 135, to which the springs 130 are hooked, is fixed to the body B. The urging force of the springs 130 is adjusted by the spring bolts 135.

The tremolo unit 110 is constructed such that the tremolo body 120 is kept in equilibrium by the tension of the strings S and the urging force of the springs 130, which acts against the tension of the strings S. When the tremolo body 120 is pivoted by manipulation of the tremolo arm 125, the tension of the strings S is increased or decreased, which raises or lowers the pitch of each string S. When the arm 125 is released, the tremolo 120 returns to the equilibrium position and the pitch of each string S returns to the original pitch.

However, the equilibrium of the tremolo body 120 is extremely sensitive and affected by various factors. For example, friction at the pivot fulcrum, imperfect resilience of the springs 130, touching of the tremolo body 120 or the tremolo arm 125 by a guitar player, choking, flatter (fluctuation of sound due to an inertial force when the player abruptly releases the tremolo arm 125), and snap of the strings S may hinder the tremolo body 120 from returning to the equilibrium position after the tremolo body 120 is pivoted. This detunes the strings S. Another significant drawback of the tremolo unit 110 is the difficulty of tuning. Specifically, when the pitch of one of the strings S is raised by increasing the tension, the sum of the tension of all the strings S is increased. This pivots the tremolo body 120 toward the neck from the equilibrium position and thus shortens the distance between the nut and the string supports 121. Accordingly, the tension of other strings S is decreased and the pitches of the other strings S are lowered. When the tension of one of the strings S is decreased, the pitches of the other strings S are raised. Thus, it is theoretically impossible to perfectly tune all the strings S. To proximate the pitches to the perfectly tuned state requires much effort.

Further, a certain correspondence is established among a target pitch, the line density, and the length of each string S. However, the scale length of the above described tremolo unit 110, in which one end of each string S is movable, is changed depending on the strength of the springs 130.

Therefore, when turning the open strings S, there are a number of neutral points at which an open string S is tuned outside the scale length. Therefore, if the tremolo unit 120 is inclined toward or away from the neck compared to the designed equilibrium position, the scale length is changed from the designed value, and the sound of a desired pitch cannot be produced when a string S is pressed against a certain fret on the neck.

The drawbacks of the tremolo unit 110 have attracted attention. Accordingly, tremolo units have been introduced in recent years having springs the tension of which is greater than those of strings. Japanese Laid-Open Patent Publication No. 1-93793 and Japanese Examined Patent Publication No. 2-48120 disclose such tremolo units. However, the mechanism disclosed in the publication No. 1-93793 requires a great force to increase the tensions of the strings to raise the pitch, or to manipulate the tremolo arm. In the tremolo unit disclosed in the publication No. 2-48120, the tremolo block is directly connected to one spring. Therefore, if the spring is inclined or deformed in a direction other than the expanding and contracting directions due to pivoting of the tremolo body, the resilience of the spring is affected. The tremolo unit has a stopper to limit the movement of the tremolo body. To reduce the noise produced by collision of the tremolo body against the stopper, a shock absorbing member, such as rubber, is located between the tremolo body and the stopper. In this case, deformation of the shock absorbing member is likely to detune the strings. Further, the tremolo unit has a number of adjusters. The locations of the adjusters are not easy to find and the procedure of adjustment is not easy to understand.

U.S. Pat. No. 4,928,564 discloses a tremolo unit having a bracket located between a tremolo block and a guitar body. A counter balance spring assembly is located on the bracket. The assembly includes a tube and a rod, which are attached to the bracket. The rod is received by the tube. One end of the rod is coupled to the tremolo block. As the tremolo block is moved, the rod moves relative to the tube, which applies an adequate tension to the tremolo arm.

The above described tremolo unit often makes players uncomfortable. For example, when the bridge or the tremolo block is returned to the neutral position, the arm cannot be smoothly manipulated. Therefore, players that prefer the feel of a floating bridge are disturbed. If the friction among the members in the counter balance spring assembly is transmitted to the player during performance of the instrument, the player may feel uncomfortable.

SUMMARY OF THE INVENTION

Accordingly, it is an objective of the present invention to provide a tremolo unit for string instrument that minimizes the degree of detuning, permits the strings to be easily and accurately tuned, and prevents a player from feeling uncomfortable during performance.

To achieve and foregoing and other objectives and in accordance with the purpose of the present invention, a tremolo unit applied to a string instrument having a base plate and a plurality of strings is provided. The base plate has a top surface and a back surface and is pivotally supported by a body. A front end of each string is supported by a neck, and a rear end of each string is supported by the top surface of the base plate. The tremolo unit permits the base plate to be pivoted in response to manipulation of a tremolo arm. The tremolo unit includes a tremolo block, a base, an engaging section, a moving member, a first spring, and a second spring. The tremolo block extends vertically from the back surface of the base plate into a space defined in the body and pivots with the base plate. The tremolo block has a hook portion at its distal end. The base is located at a back portion of the body. The engaging section is formed at a rear portion of the base and opens rearward. The moving member is detachably located at the engaging section. The moving member is moved between an engaging position, at which the moving member engages with the engaging section, and a standby position, at which the moving member is separated from the engaging section. The first spring connects the base with the tremolo block, and urges the tremolo block forward against tension of the strings. The urging force of the first spring is adjustable. The second spring connects the base with the moving member, and urges the moving member toward the engaging position. In a normal state, the second spring holds the moving member at the engaging position. When the tremolo block is stopped or pivoted forward, the moving member is held at the engaging position by the urging force of the second spring. When the tremolo block is pivoted rearward, the moving member is moved from the engaging position to the standby position by contact between the moving member and the hook portion.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A preferred embodiment of the present invention will now be described with reference to the drawings.

Figure 1:
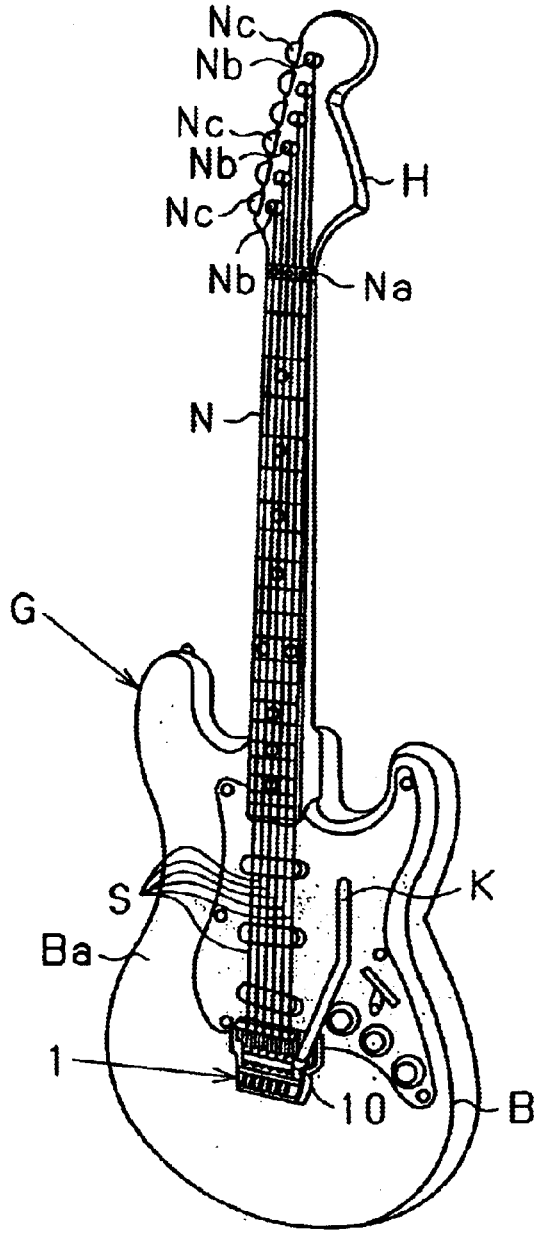
FIG. 1 is a perspective view illustrating an electric guitar equipped with a tremolo unit according to the present invention.
Figure 2:
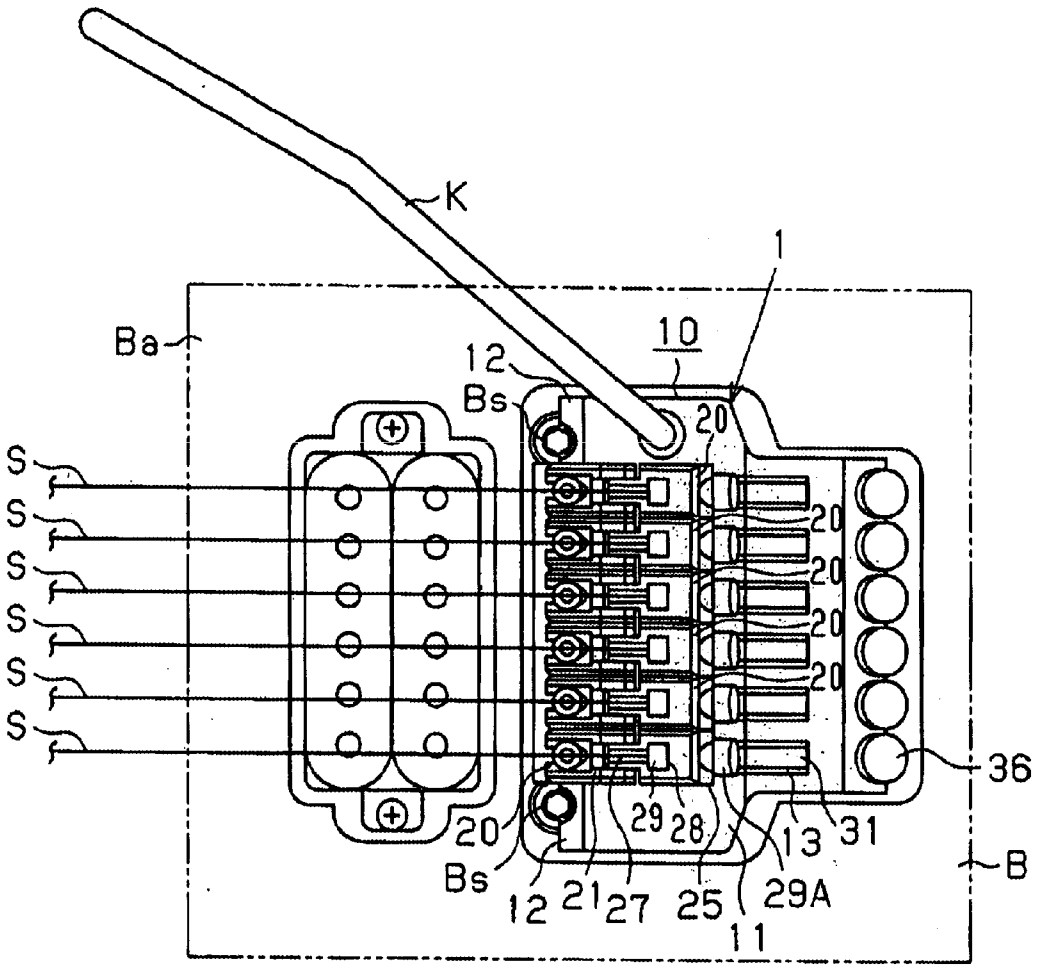
FIG. 2 is a plan view showing the tremolo unit of FIG. 1.

FIG. 1 shows a string instrument, which is an electric guitar G in this embodiment. The guitar G includes a neck N, a body B, and six strings S. A head H is located at the top end of the neck N. Tuning posts Nb are provided on the head H. One end of each string S is held by one of the tuning posts Nb. A tremolo unit 1 is located in the body B. The tremolo unit 1 forms a bridge and functions as a string tuning device and a pitch changing device. One end of each string S that is opposite from the end held at the head H is held by the tremolo unit 1. A nut Na is located at the front end of the neck N to support a section of the strings S at the end of the neck N connected to the head H. Tuning pegs Nc are provided at the head H. The tuning pegs Nc are connected to the tuning posts Nb and are used for tuning the strings S.

As shown in FIGS. 2 to 6, the tremolo unit 1 includes a tremolo body 10, a tremolo arm K, and a back mechanism 60. The tremolo arm K is detachably connected to the tremolo body 10 and is used for manipulating the tremolo body 10. The back mechanism 60 forms a tremolo body returning mechanism, which returns the tremolo body 10 to an equilibrium position after the tremolo body 10 is pivoted. The back mechanism 60 is located in a recess Bb formed in a back portion of the body B.

In this embodiment, the tremolo body 10 includes a base plate 11, six independent string supports (bridge saddles) 20, a tremolo block 40. The base plate 11 has a top surface and a back surface and is pivotally attached to the top surface Ba of the body B. The bridge saddles 20 are located on the base plate 11 to support the rear ends of the strings S. (As used herein, the terms forward and front refer to positions toward the neck, and the term rear refers to positions away from the neck.) The tremolo block 40 extends vertically from the back of the base plate 11. As the tremolo arm K is pulled up and pushed down, the tremolo block 40 pivots forward and rearward in a through space Bc of the body B.

Figure 3:
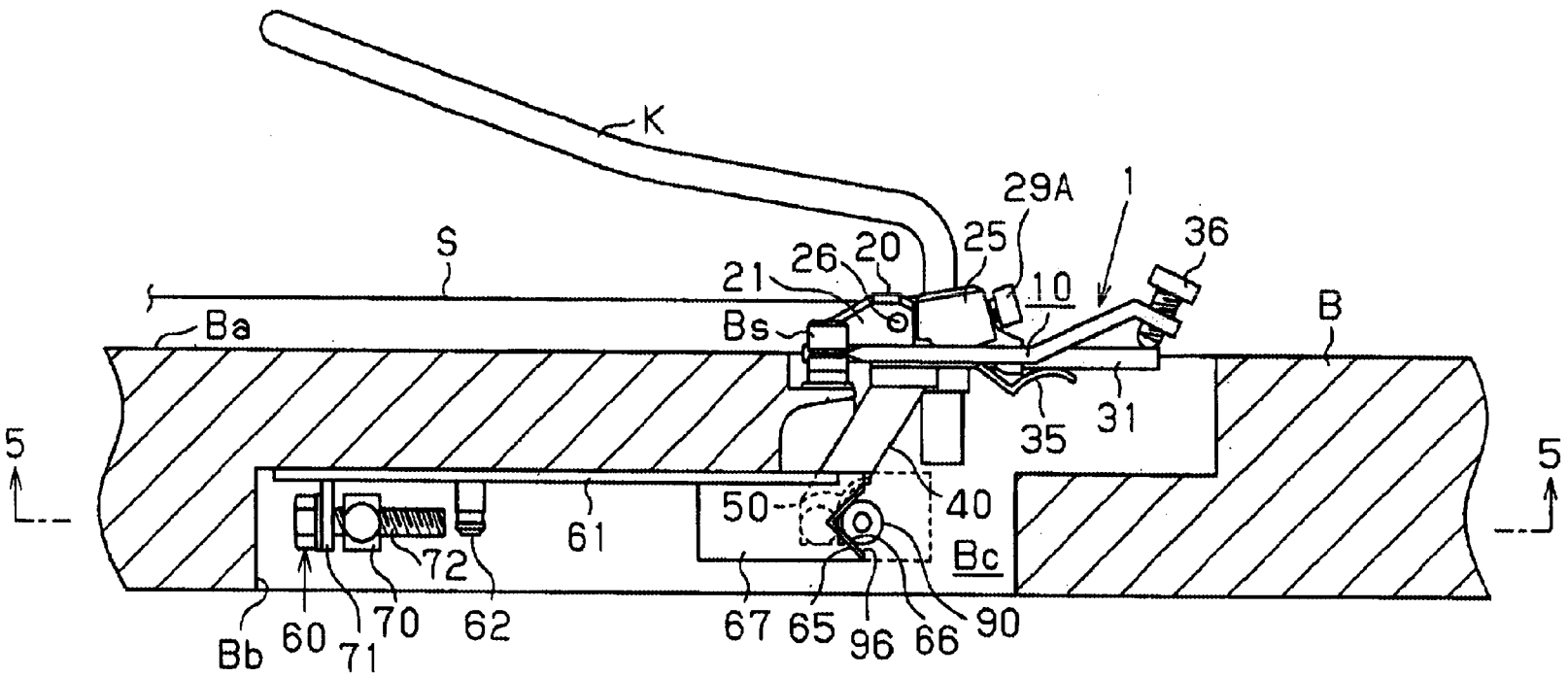
FIG. 3 is a cross-sectional view showing the tremolo unit of FIG. 1 with some members removed for purposes of illustration.
Figure 4:
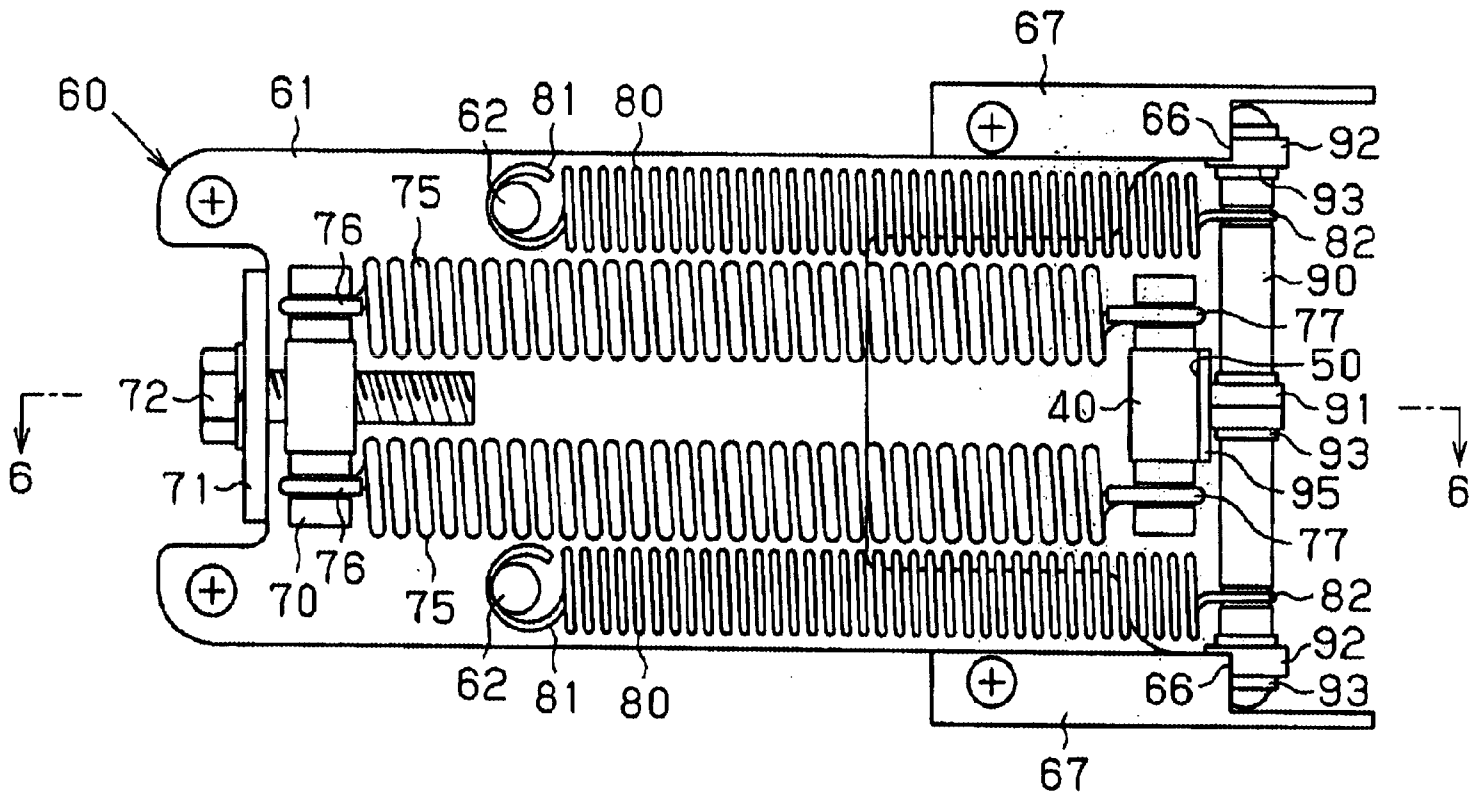
FIG. 4 is a back view of the tremolo unit of FIG. 1.
Figure 5:
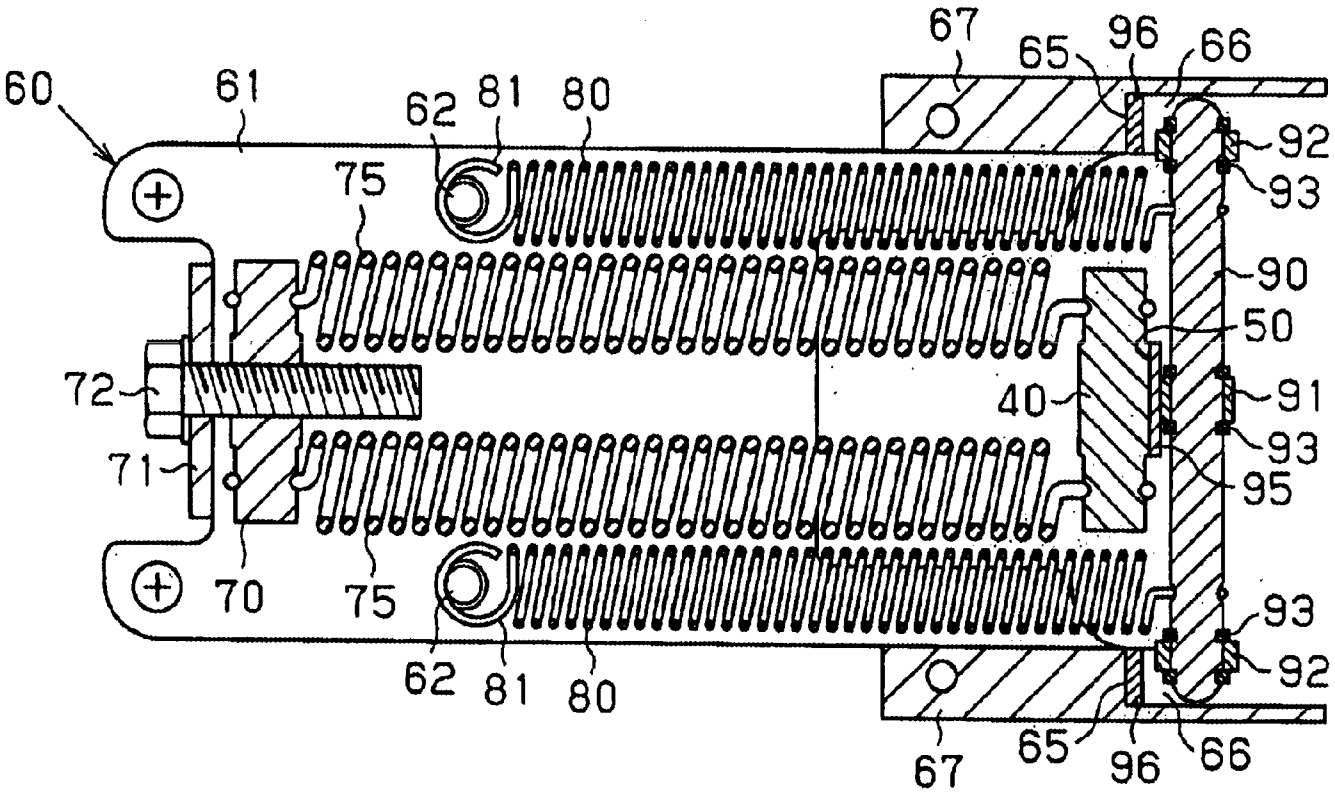
FIG. 5 is a cross-sectional view taken along line 5—5 of FIG. 3.
Figure 6:
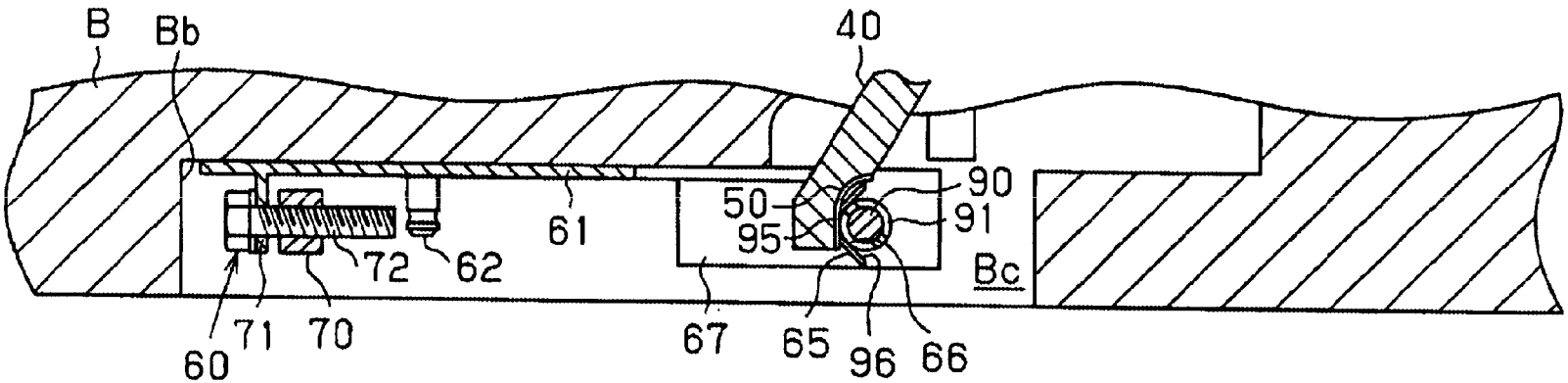
FIG. 6 is a cross-sectional view taken along line 6—6 of FIG. 4.

In this embodiment, the string supports 20 are located on the base plate 11. Each string support 20 corresponds to one of the strings S. The string supports 20 permit the timbre of each string S to be adjusted. FIG. 3 illustrates the tremolo unit 1 and its surroundings when the tremolo body 10 is at the equilibrium position and the player is not using the tremolo unit 1. FIG. 4 illustrates the back mechanism 60 at the equilibrium position.

The base plate 11 has knife edges 12 at both sides of the front end, or the end closer to the neck N. The base plate 11 is pivotally supported by stud bolts Bs, each holding one of the knife edges 12. Six grooves 13 are formed in the base plate 11. Each groove 13 corresponds to one of the string supports 20.

Each string support 20 has a saddle holder 21, a saddle main body 25, and an adjuster rod 31. Each saddle holder 21 is attached to the base plate 11. The position of each saddle holder 21 is moved forward and rearward. Each saddle main body 25 is pivotally supported by the corresponding saddle holder 21 with a pin 26 extending perpendicular to the strings S. Each saddle main body 25 has a string receiving portion 27, which is formed as a curved surface. The string receiving portion 27 is located at the front end of the saddle main body 25. Each saddle main body 25 also has a string fixing recess 28 at a rear section. A block 29 is inserted into the string fixing recess 28 to hold the corresponding string S between the inner wall of the recess 28 and the block 29. A holding screw 29A is threaded to each saddle main body 25. The distal end of the screw 29A protrudes into the recess 28 and holds the block 29.

Each adjuster rod 31 extends rearward from the rear side of one of the saddle main bodies 25. The adjuster rod 31 is used for adjusting the rotational position of the saddle main body 25. Each adjuster rod 31 is located in one of the grooves 13 formed on the base plate 11. Leaf springs 35 are located at the back of the base plate 11. Each leaf spring 35 corresponds to one of the adjuster rod 31. Each leaf spring 35 constantly urges the corresponding saddle main body 25 counterclockwise about the pin 26 through the adjuster rod 31. Six string tuning bolts (fine tuning bolts) 36 are provided at the rear end of the base plate 11. Each string tuning bolt 36 contacts one of the adjuster rods 31. Each string tuning bolt 36 is threaded up and down as viewed in FIG. 3 to pivot the corresponding saddle main body 25 to tune the corresponding string S. When each string tuning bolt 36 is rotated clockwise, the corresponding saddle main body 25 is pivoted clockwise through the corresponding adjuster rod 31. That is, the saddle main body 25 is pivoted rearward. This increases the tension of the corresponding string S, or raises the pitch of the string S. When each string tuning bolt 36 is rotated counterclockwise, the corresponding saddle main body 25 is pivoted counterclockwise through the corresponding adjuster rod 31. That is, the saddle main body 25 is pivoted forward. This decreases the tension of the corresponding string S, or lowers the pitch of the string S.

In the illustrated embodiment, the string supporting members 20, which have the saddle holders 21 and the saddle main bodies 25, are locking types. However, the present invention may be applied to non-locking type string supporting members. In the illustrated embodiment, the string supporting members 20 are independent from one another so that each supporting member 20 supports one of the strings S to adjust the timbre of each string S. However, the present invention may be applied to a base plate having a one piece type string supporting member.

The tremolo unit of this embodiment includes a hook portion 50 formed on the tremolo block 40 and the back mechanism 60. The back mechanism 60 includes engaging sections 65, an adjusting member 70, first springs 75, second springs 80, and a rod member 90.

As shown in FIGS. 3 to 10, the tremolo block 40 extends vertically toward the back of the body B from the base plate 11 of the tremolo body 10. The hook portion 50 is formed at a rear section in the vicinity of the distal end of the tremolo block 40. When the tremolo block 40 is pivoted backward, the hook portion 50 contacts the rod member 90. Therefore, as illustrated, the hook portion 50 is preferably formed as a concave surface with the open distal end.

The back mechanism base 61 is used for attaching the back mechanism 60 to the body B. Specifically, the back mechanism base 61 is fixed to the recess Bb formed in the back of the body B with appropriate members such as screws.

As shown in FIGS. 3 to 10, the engaging sections 65 are located at the sides of the back mechanism base 61. Each engaging section 65 has an open portion 66, which opens rearward. In this embodiment, projecting blocks 67 are formed integrally with the back mechanism base 61. The projecting blocks 67 are located at the side sections of the back mechanism base 61. Each engaging section 65 is a V-shaped notch formed in one of the projecting blocks 67. However, as long as the engaging sections 65 receive the rod member 90, the structures and the shapes of the sections 65 may be changed. The rod member 90 serves as a moving member, which is moved between an engaging position, at which the moving member engages with the engaging section 65, and a standby position, at which the moving member is separated from the engaging section 65. Preferably, the rod member 90 has a circular cross-section.

The adjusting member 70 is located at the front section of the back mechanism base 61 and is moved forward and rearward (i.e., toward and away from the neck). An adjuster bolt 72 is threaded to a bracket 71 extending from the base mechanism 61. The adjusting member 70 is threaded to the adjuster bolt 72. As the bolt 72 is rotated, the adjusting member 70 is moved forward or rearward.

Each first spring 75 has a front end 76 and a rear end 77. The front ends 76 are secured to the adjusting member 70, and the rear ends 77 are fixed to the lower part of the tremolo block 40. The first springs 75 thus constantly urge the tremolo block 40 forward against tension of the strings. In this embodiment, the two first springs 75 are located at side sections of the adjusting member 70.

Each second spring 80 has a front end 81 and a rear end 82. The front ends 81 are secured to the back mechanism base 61. Specifically, each front end 81 is hooked on an engaging projection 62 formed on the back mechanism base 61. In this embodiment, the second springs 80 are located outward of the first springs 75.

The rod member 90 is located rearward of the tremolo block 40. The rear ends 82 of the second springs 80 are engaged with the rod member 90 to constantly urge the rod member 90 forward. When the tremolo block 40 is not pivoted or when the tremolo block 40 is pivoted forward, the rod member 90 is engaged with the engaging sections 65. When the tremolo block 40 is pivoted rearward, the rod member 90 is engaged with the hook portion 50 formed on the tremolo block 40 and moved rearward away from the engaging sections 65. At this time, the rod member 90 slides on the lower slopes of the engaging sections 65 before being separated from the engaging sections 65.

As described above, the position of the adjusting member 70 is changed by rotating the adjuster bolt 72 to adjust the force of the first springs 75. This permits the force of the springs 75 to be adjusted in accordance with the tensions of the strings S at various string gauges. Also, the inclination angle of the tremolo body 10 (the base plate 11) relative to the stud bolts Bs is adjusted.

In the normal state, or when the tremolo body 10 is in the equilibrium position, the first springs 75 are extended longer than the normal lengths and urge the tremolo block 40 forward. Also, the second springs 80 extended longer than the normal lengths and urges the rod member 90 forward so that the rod member 90 engages with the engaging sections 65. In this state, the tremolo body 10 (the base plate 11) is at a reference angle, at which the player is not using tremolo.

Figure 11:
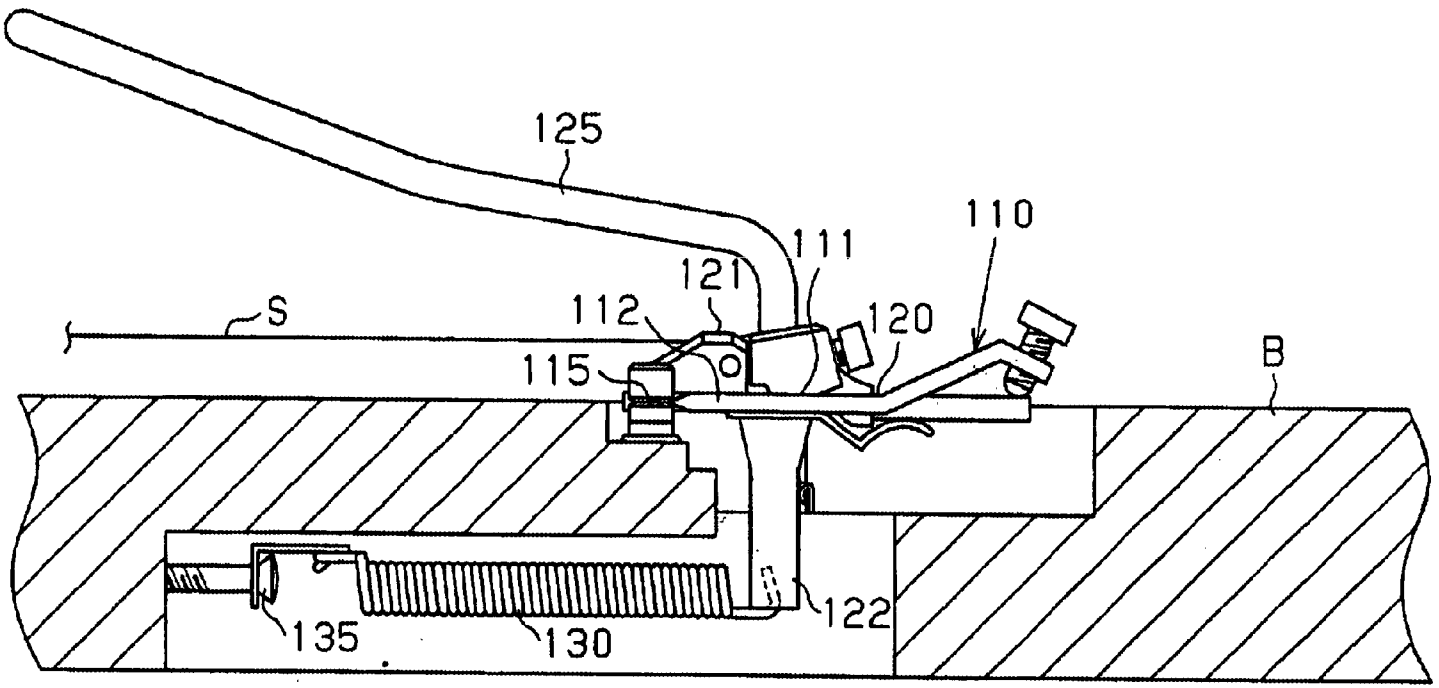
Fig.11 (Prior Art)
FIG. 11 is a cross-sectional view illustrating a typical prior art tremolo unit installed in a string instrument.

When the strings S have no tension, the tremolo block 40 is moved to the front end of the moving range by the first springs 75. When strings S are tuned, tension is applied to each string S. Accordingly, the tremolo block 40 is moved rearward until the hook portion 50 are engaged with the rod member 90. In this state, the tremolo block 40 is at the equilibrium state. If the force of the springs 75 is not sufficient, the tension of the strings S causes the engaging hook portion 50 to contact the rod member 90 and moves the rod member 90 rearward away from the engaging sections 65. If the force of the first springs 75 are excessive, the tension of the strings S and the force of the first springs 75 are balanced before the hook portion 50 contacts the rod member 90. In this state, the tremolo block 40 is floating and unstable as the prior art tremolo unit 110 shown in FIG. 11.

Therefore, it is preferable that the force of the first springs 75 be slightly less than the tension of the strings S and the force of the second springs 80 be adjusted such that the hook portion 50 of the tremolo block 40 contact the rod member 90 without separating the rod member 90 from the engaging sections 65. However, if the player prefers the floating state, the tremolo unit 1 may be adjusted differently. If the second springs 80 and the rod member 90 are removed from the back mechanism 61, the tremolo unit 1 functions in the same way as the prior art tremolo unit 110.

A bearing 91 is attached to the rod member 90 at a position that contacts the hook portion 50 of the tremolo block 40. When the tremolo block 40 is pivoted rearward, the bearing 91 rotates on the hook portion 50, which reduces friction between the hook portion 50 and the rod member 90. The hook portion 50 is formed concave to facilitate contact with the bearing 91 when the tremolo block 40 is pivoted rearward and moved to the original position. The bearing 91 is attached to the rod member 90 with a pair of rings 93.

Two bearings 92 are also attached to the rod member 90. The bearings 92 are located at a position at which the rod member 90 contacts the engaging sections 65. Each bearing 92 is attached to the rod member 90 with a pair of rings 93. When the tremolo block 40 is returned to the original position (the equilibrium position) after being pivoted rearward, the force of the second springs 80 causes the rod member 90 to contact the open portions 66 of the engaging sections 65. At this time, the bearing 92 reduces friction between the rod member 90 and the open sections 66.

Since the hook portion 50 of the tremolo block 40 is formed concave, the displacement between the hook portion 50 and the rod member 90 is absorbed when the tremolo block 40 is pivoted rearward. This facilitates a continuous rearward pivoting of the tremolo block 40.

A rubber shock absorbing member 95 is attached to the hook portion 50 of the tremolo block. A rubber shock absorbing member 96 is attached to each engaging section 65. The shock absorbing members 95, 96 absorb shock when the bearings 91, 92 contact the hook section 50 and the engaging sections 65, thereby reducing noise.

Figure 7:
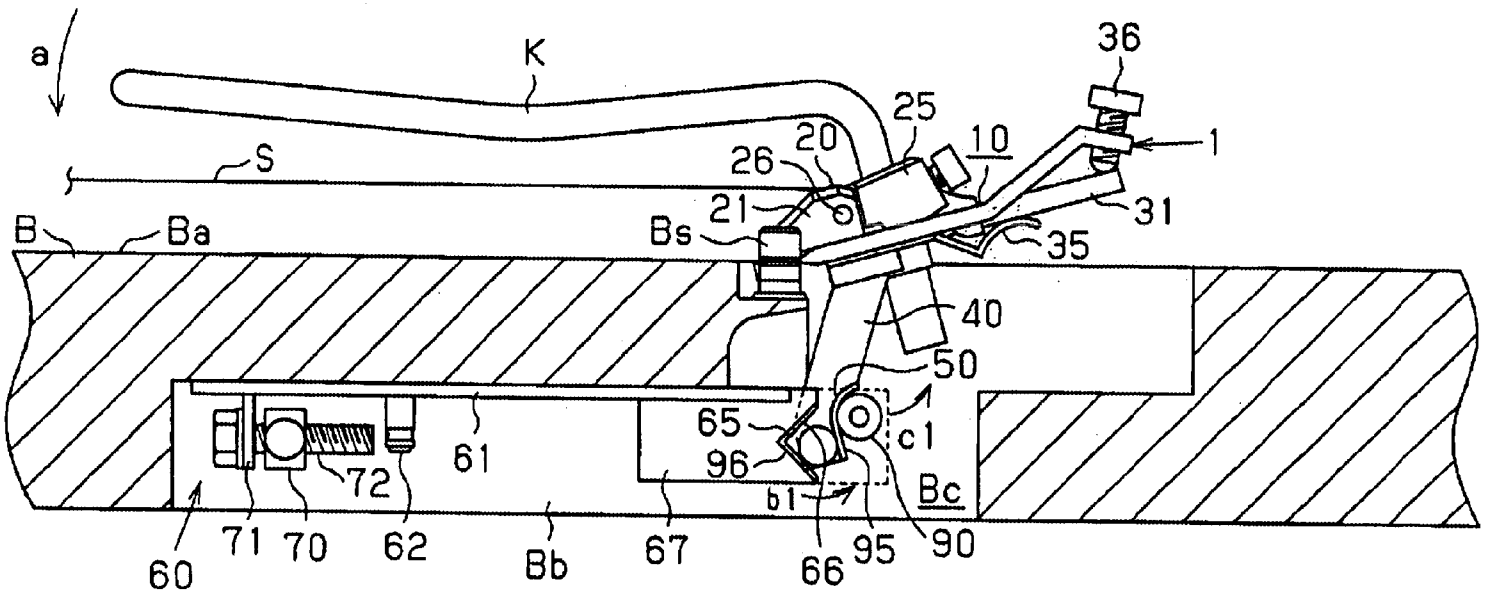
FIG. 7 is a partial cross-sectional view showing the tremolo unit of FIG. 1 when the arm is pushed down.
Figure 8:
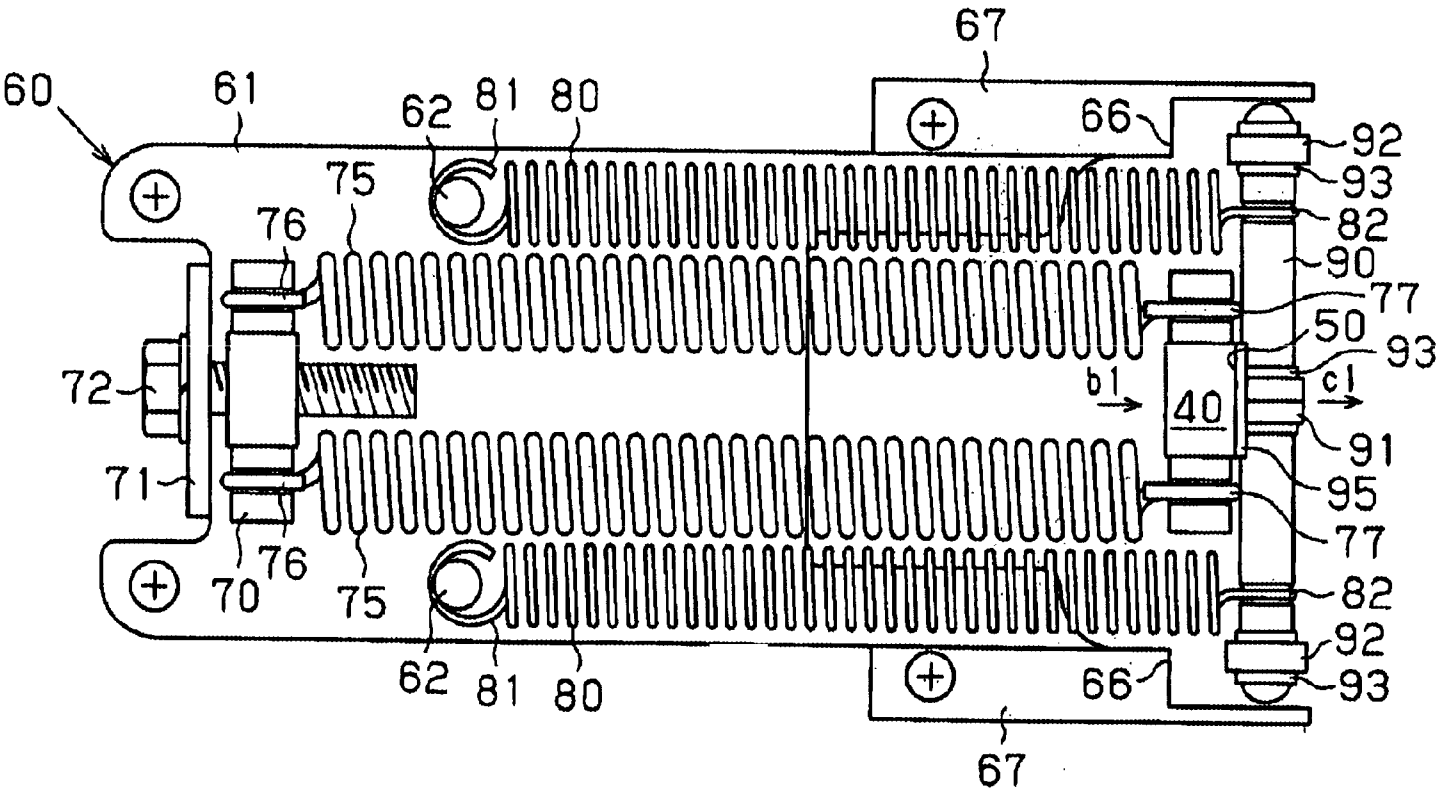
FIG. 8 is a back view of the tremolo unit of FIG. 1 when the arm is pushed down.

The operation of the tremolo unit 1 will now be described. When the tremolo arm K is pushed down toward the top body surface Ba in a direction of arrow a as shown in FIG. 7, the tremolo body 10 (the base plate 11) is pivoted about the stud bolts Bs such that the rear section of tremolo body 10 is inclined upward. This reduces the tension of the strings S and lowers, or flats, the pitches of the strings S. As shown in FIGS. 7 and 8, the tremolo block 40 at the back of the base plate 11 is pivoted rearward as shown by arrow b1 in the space Bc of the body B. Accordingly, the first springs 75 between the adjuster member 70 and the tremolo block 40 are extended. At the same time, the tremolo block 40 contacts the rod member 90 at the hook portion 50 and pushes the rod member 90 rearward away from the open sections 66 of the engaging sections 65 in a direction shown by arrow c1. Accordingly, the second springs 80 are extended.

When the tremolo arm K is released after being pushed down, the first springs 75 and the second springs 80 pivot the tremolo block 40 forward in the space Bc about the stud bolts Bs, or a direction opposite to the direction shown by arrow B1. The tremolo block 40 is then returned to the initial equilibrium position shown in FIGS. 3 to 6. The rod member 90 is also moved forward, or in a direction opposite to the direction shown by arrow c1, and engages with the engaging portions 65.

Figure 9:
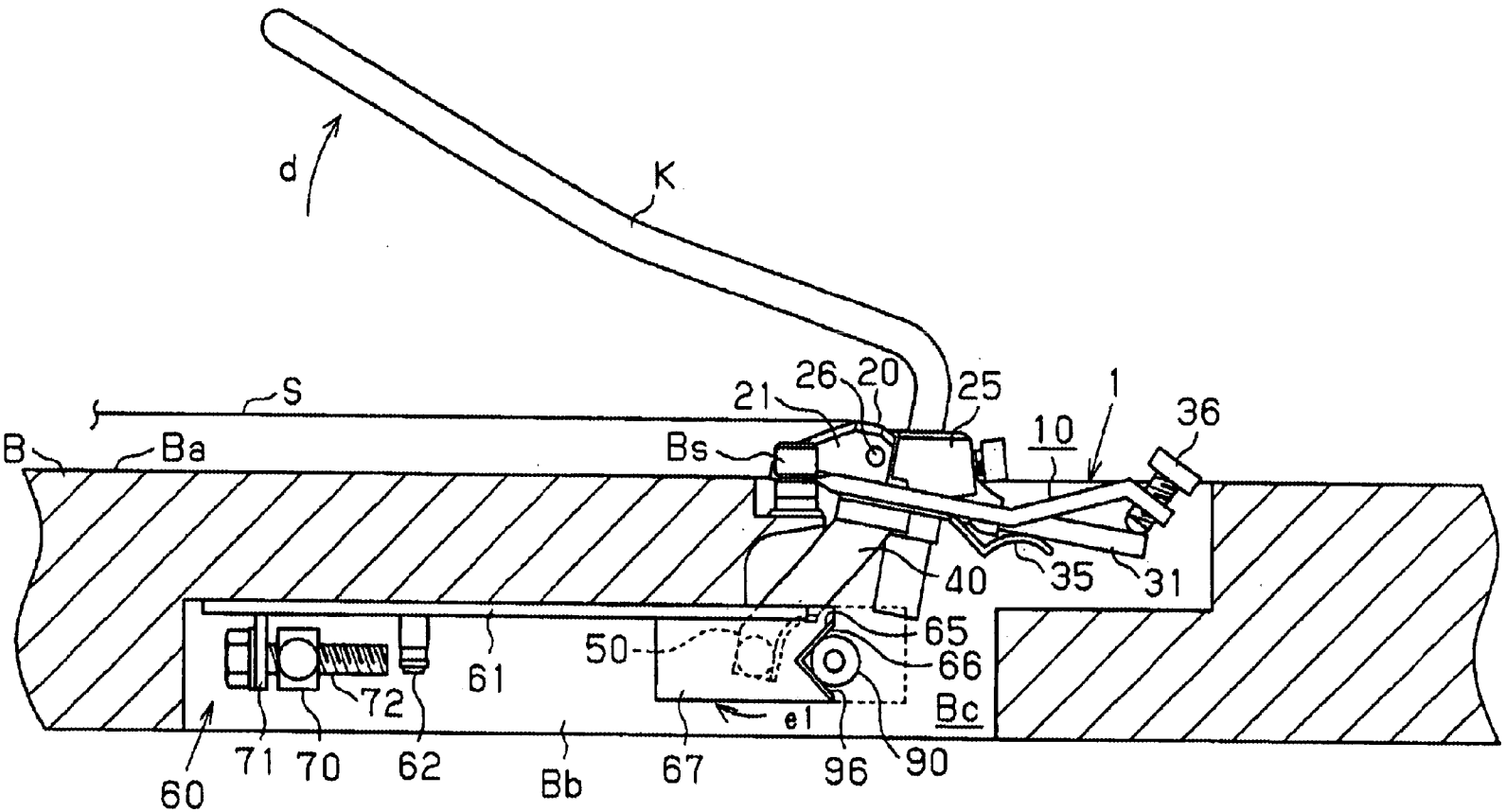
FIG. 9 is a partial cross-sectional view showing the tremolo unit of FIG. 1 when the arm is pulled up.
Figure 10:
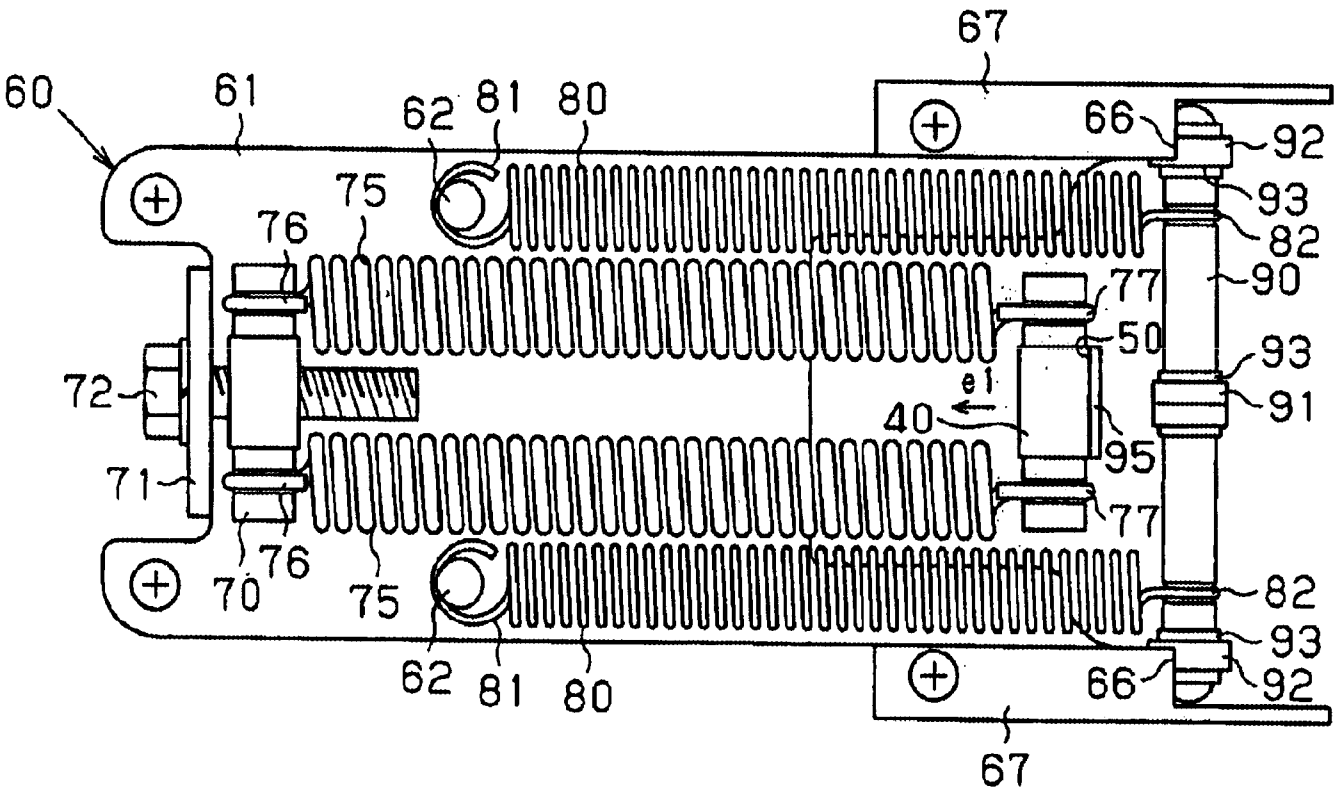
FIG. 10 is a back view of the tremolo unit of FIG. 1 when the arm is pulled up.

When the tremolo arm K is pulled up away from the body surface B1 in a direction shown by arrow d as shown in FIG. 9, the base plate 11 of the tremolo body 10 is pivoted such that the rear portion is inclined downward about the stud bolts Bs. This increases the tension of the strings S so that the pitch of each string S is raised, or sharped. At this time, as shown in FIGS. 9 and 10, the tremolo block 40, which is located at the back of the base plate 11, is pivoted forward as shown by arrow e1. Accordingly, the first springs 75 are contracted. At this time, the second springs 80 maintain the rod member 90 engaged with the engaging members 65.

When the tremolo arm is released K after being pulled up, the tension of the strings S pivots the tremolo block 40 about the stud bolts Bs rearward in the space Bc, or in a direction opposite to the direction of arrow e1. Then, the tremolo block 40 is returned to the initial equilibrium position shown in FIGS. 3 to 6.

It should be apparent to those skilled in the art that the present invention may be embodied in many other specific forms without departing from the spirit or scope of the invention. Particularly, it should be understood that the invention may be embodied in the following forms. For example, in the above embodiment the number of the first springs 75 and the number of the second springs 80 are both two. However, the numbers of the springs 75, 80 may be changed as necessary.

Although the above embodiments are applied to a tremolo unit of a six-string guitar, the present invention may be applied to other types of string instruments such as base guitars.

Therefore, the present examples and embodiments are to be considered as illustrative and not restrictive and the invention is not to be limited to the details given herein, but may be modified within the scope and equivalence of the appended claims.

What is claimed is:

1. A tremolo unit applied to a string instrument having a base plate and a plurality of strings, wherein the base plate has a top surface and a back surface and is pivotally supported by a body, wherein a front end of each string is supported by a neck, and a rear end of each string is supported by the top surface of the base plate, wherein the tremolo unit permits the base plate to be pivoted in response to manipulation of a tremolo arm, the tremolo unit comprising:

a tremolo block, wherein the tremolo block extends vertically from the back surface of the base plate into a space defined in the body and pivots with the base plate, and wherein the tremolo block has a hook portion at its distal end;

a base located at a back portion of the body;

an engaging section formed at a rear portion of the base, wherein the engaging section opens rearward;

a moving member detachably located at the engaging section, wherein the moving member is moved between an engaging position, at which the moving member engages with the engaging section, and a standby position, at which the moving member is separated from the engaging section;

a first spring connecting the base with the tremolo block, wherein the first spring urges the tremolo block forward against tension of the strings, and wherein the urging force of the first spring is adjustable; and a second spring connecting the base with the moving member, wherein the second spring urges the moving member toward the engaging position, and wherein, in a normal state, the second spring holds the moving member at the engaging position, wherein, when the tremolo block is stopped or pivoted forward, the moving member is held at the engaging position by the urging force of the second spring, and wherein, when the tremolo block is pivoted rearward, the moving member is moved from the engaging position to the standby position by contact between the moving member and the hook portion.

2. The tremolo unit according to claim 1, wherein a bearing is located at a portion of the moving member that corresponds to the hook portion.

3. The tremolo unit according to claim 1, wherein a bearing is located at a portion of the moving member that corresponds to the engaging section.

4. The tremolo unit according to claim 1, wherein the moving member is formed as a rod, and wherein the engaging section is one of a pair of engaging sections corresponding to the ends of the moving member.

5. The tremolo unit according to claim 4, wherein the moving member has a circular cross-section, and wherein the hook portion is formed concave.

6. The tremolo unit according to claim 1, wherein a shock absorbing member is provided at the hook portion.

7. The tremolo unit according to claim 1, wherein a shock absorbing member is provided at the engaging section.

8. A tremolo unit applied to a string instrument having a base plate and a plurality of strings, wherein the base plate has a top surface and a back surface and is pivotally supported by a body, wherein a front end of each string is supported by a neck, and a rear end of each string is supported by the top surface of the base plate, wherein the tremolo unit permits the base plate to be pivoted in response to manipulation of a tremolo arm, the tremolo unit comprising:

a tremolo block, wherein the tremolo block extends vertically from the back surface of the base plate into a space defined in the body and pivots with the base plate, and wherein the tremolo block has hook portion at its distal end;

a base located at a back portion of the body;

a pair of engaging sections formed in side sections at a rear portion of the base, wherein each engaging section opens rearward;

a moving member detachably located at the engaging sections, wherein the moving member is moved between an engaging position, at which the moving member engages with the engaging sections, and a standby position, at which the moving member is separated from the engaging sections;

a pair of first springs connecting the base with the tremolo block, wherein the first springs urge the tremolo block forward against tension of the strings, and wherein the urging force of the first springs is adjustable; and a pair of second springs located outward of the first springs, wherein the second springs connect the base with the moving member, wherein the second springs urge the moving member toward the engaging position, and wherein, in a normal state, the second springs hold the moving member at the engaging position, wherein, when the tremolo block is stopped or pivoted forward, the moving member is held at the engaging position by the urging force of the second springs, and wherein, when the tremolo block is pivoted rearward, the moving member is moved from the engaging position to the standby position by contact between the moving member and the hook portion.

9. The tremolo unit according to claim 8, wherein a bearing is located at a portion of the moving member that corresponds to the hook portion.

10. The tremolo unit according to claim 8, wherein a pair of bearings are located at portions of the moving member that correspond to the engaging sections.

11. The tremolo unit according to claim 8, wherein the moving member is formed as a rod, and wherein the engaging sections correspond to the ends of the moving member.

12. The tremolo unit according to claim 9, wherein the moving member has a circular cross-section, and wherein the hook portion is formed concave.

13. The tremolo unit according to claim 8, wherein a shock absorbing member is provided at the hook portion.

14. The tremolo unit according to claim 8, wherein a shock absorbing member is provided at each engaging section.

15. The tremolo unit according to claim 8, wherein an adjusting member is attached to the base, wherein the position of the adjusting member is adjustable along the longitudinal direction of the strings, and wherein the first springs connect the adjusting member with the tremolo block.

* * * * *